United States Patent [19]

Schellenberg et al.

[11] 4,194,350

[45] Mar. 25, 1980

[54] THREAD DEFLECTING ELEMENT FOR A DRAW-TEXTURING MACHINE

[75] Inventors: Hans Schellenberg; Walter Vetterli, both of Winterthur, Switzerland

[73] Assignee: Rieter Machine Works Ltd., Winterthur, Switzerland

[21] Appl. No.: 927,574

[22] Filed: Jul. 24, 1978

[30] Foreign Application Priority Data

Jul. 23, 1977 [CH] Switzerland ..... 9117/77

[51] Int. Cl.[2] ..... D01H 13/04; D01H 13/08

[52] U.S. Cl. ..... 57/352; 226/97; 242/157 R

[58] Field of Search ..... 57/34 HS, 106, 282, 57/290, 315, 328, 331, 350, 352; 226/97; 242/147 A, 157 R; 219/201

[56] References Cited

U.S. PATENT DOCUMENTS

| | | | |
|---|---|---|---|
| 3,245,334 | 4/1966 | Long | 226/97 X |
| 3,407,585 | 10/1968 | Hilbert | 57/34 HS |
| 3,449,898 | 6/1969 | Fujita et al. | 57/34 HS |
| 3,484,032 | 12/1969 | Aldrich et al. | 57/34 HS |
| 3,485,429 | 12/1969 | Hutzenlaub | 226/97 |
| 3,979,037 | 9/1976 | Burdorf | 226/97 |
| 3,999,970 | 12/1976 | Barch et al. | 242/157 R X |
| 4,043,495 | 8/1977 | Sander | 226/97 X |

FOREIGN PATENT DOCUMENTS

| | | | |
|---|---|---|---|
| 1107723 | 3/1968 | United Kingdom | 242/147 A |

*Primary Examiner*—Donald Watkins
*Attorney, Agent, or Firm*—Kenyon & Kenyon

[57] ABSTRACT

The thread deflecting element is provided with an arcuate groove through which the thread passes as well as with compressed air ducts which deliver compressed air at the entrance of the groove on the side within the groove curvature and at a point downstream of the groove apex on the side outside the groove curvature. The air is delivered via ducts within the plate forming the deflecting element. The travelling thread is relieved of a degree of tension in the deflecting element so as to equalize the tension in the two lengths of the thread loop passing over the two heating paths of the heater.

18 Claims, 3 Drawing Figures

III
III

THREAD DEFLECTING ELEMENT FOR A DRAW-TEXTURING MACHINE

This invention relates to a thread deflecting element. More particularly, this invention relates to a thread deflecting element for a heater in a draw-texturing machine.

As is known, draw-texturing machines have frequently been provided with a false twist device in order to impart a false twist texturing to a thread. To this end, the thread is usually drawn between two pairs of rolls and guided over a heater located between the rolls and through a false twist device also located between the rolls downstream of the heater. Subsequently, the thread is relaxed between the second pair of rolls and a third pair of rolls and is guided over a set heater between these pairs of rolls. The elasticity of the thread is also reduced on the set heater.

If the texturing processing speed is to be increased in these machines, a greater length is required of the set heater in order to maintain the same exposure time on the set heater. Since the length of the set heater cannot be increased indefinitely, some machines have utilized devices for deflecting the thread at the end of the set heater in order to guide the thread back over the heater a second time.

If the thread is deflected by a pin or roll, the thread is tensioned additionally. As the thread, however, is to be deflected in a tension-free manner, if possible with a reduction of the prevailing thread tension, the additional thread tension caused by the deflection is undesirable.

Heretofore, it has been known, for example from German Pat. OS No. 2.534.598 to use a deflecting element for gently treating a thread at high temperatures and at high transporting speed. In this case, the deflecting element is provided with a hollow recess that can be connected to a supply duct for a treatment medium and with a plurality of exit openings which extend from the hollow recess to a circumferential processing surface. The use of such a deflecting element allows the thread to be deflected practically without friction so that the thread tension can also be kept low. However, such deflecting elements are not suitable for deflecting a thread on a set heater as the prevailing thread tension is not reduced and as the thread is lifted off from the elements with a loop formation.

Accordingly, it is an object of the invention to provide a thread deflecting element for a heater of a draw-texturing machine which is capable of deflecting a thread without imparting additional tension to the thread.

It is another object of the invention to deflect a travelling thread without friction in a draw-texturing machine.

It is another object of the invention to transport a travelling thread through a deflecting element in a tension-free manner.

It is another object of the invention to reduce the prevailing thread tension in a travelling thread being processed on a heater of a draw-texturing machine.

Briefly, the invention provides a thread deflecting element for a heater of a draw-texturing machine which includes a means defining an arcuate groove for passage of a thread, a first duct merging into the groove from a side within the curvature of the groove, and a second duct merging into the groove from an opposite side outside the curvature of the groove. The groove which may be of semi-circular curvature is formed with a thread entrance at one end and a thread exit at the opposite end while the first duct merges into the groove approximately tangentially at the thread entrance. The other duct merges into the groove downstream of the apex of the groove.

Both ducts are used to deliver compressed air into the groove such that a thread is transported through the groove on an air cushion practically without contact and, thus, without friction.

The means defining the arcuate groove includes a mounting plate, a counter-piece mounted on the mounting plate and a plate clamped between the mounting plate and the counter-piece.

The clamped plate has a semi-circular face side defining one side of the groove. Also, a cover plate is mounted on the mounting plate with a counter-face side concentric to and spaced from the face side of the plate.

Both the plate and cover plate contain a hollow recess in communication with a respective duct while another duct extends through the mounting plate to deliver compressed air from a suitable source. A pair of branch ducts extend from this duct to the respective hollow recesses in order to deliver the compressed air to the recesses and, thus, to the ducts merging into the thread groove.

These and other objects and advantages of the invention will become more apparent from the following detailed description taken in conjunction with the accompanying drawings wherein.

Figures 1, 2, 3:
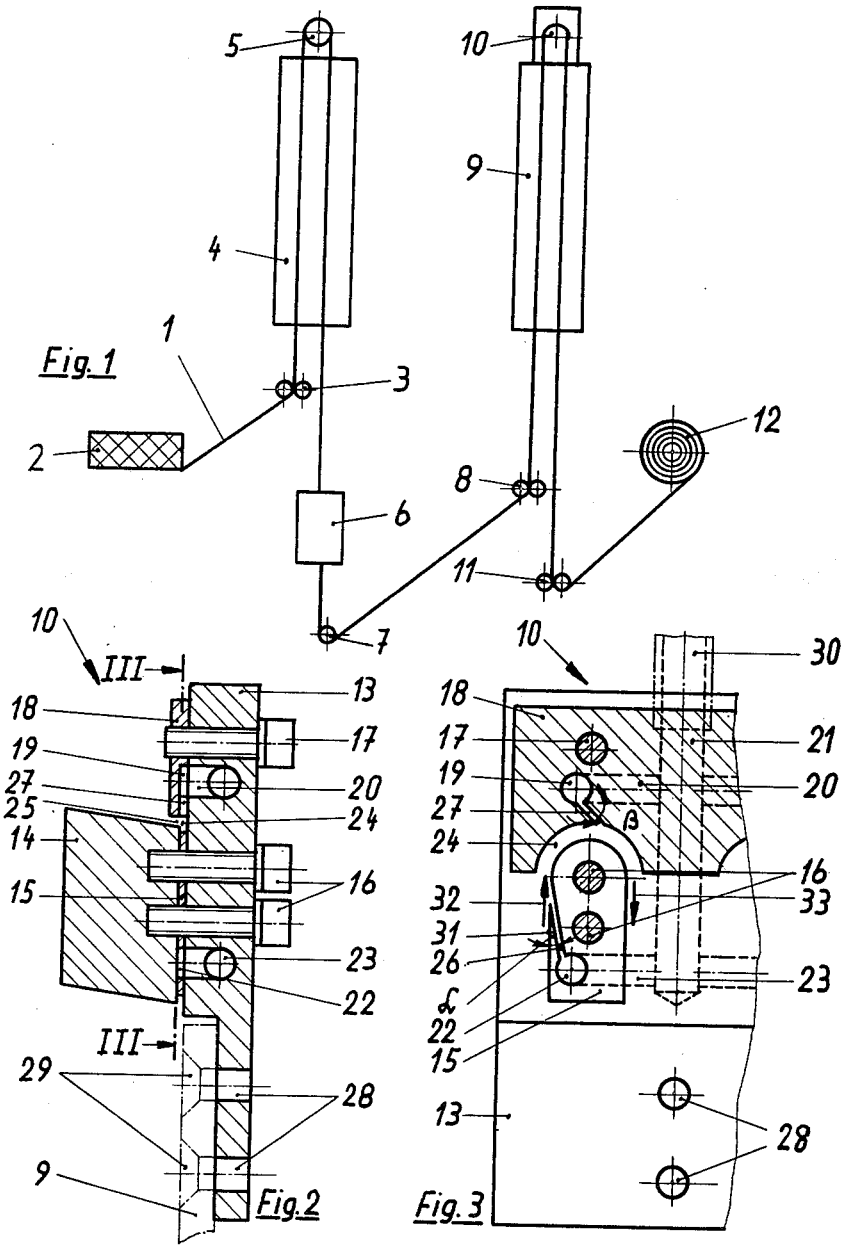
FIG. 1 illustrates a schematic view of the thread path on a draw-texturing machine.
FIG. 2 illustrates a cross-sectional view of a thread deflecting element according to the invention.
FIG. 3 illustrates a view taken on line III—III of FIG. 2.

Referring to FIG. 1, the draw-texturing machine is of generally conventional structure for draw-texturing a thread 1. As shown, the thread is supplied overhead from a creel package 2 and is guided by a transporting device 3 consisting of a pair of rolls over a main heater 4 to a deflecting element 5. Upon deflection, the thread 1 is brought back over the heater 4 into a false twist device 6 and is guided over a deflecting element 7 via a second transporting device 8 and over a set heater 9 to a deflecting element 10. Upon deflection, the thread 1 is brought back over the set heater 9 and upon passing through a further transporting device 11 is finally wound onto a bobbin package 12.

During operation, the thread 1 is relaxed between the transporting device 8 and 11 and in the relaxed state is heated. In order to reach the relaxed thread state, the transporting device 11 runs slower than the transporting device 8. For an optimum set process, identical thread tension conditions are required on both set heater passages, i.e. before and after the thread deflecting element 10. This implies that, in deflecting the thread, not only is no additional thread tension to be caused, but also that the tension generated in the thread by air friction, heater friction and thread weight is to be reduced to zero. In this case, symmetrical conditions prevail with respect to the set heater, as the thread tension reached upstream from the deflecting element after the first passage over the heater corresponds to the thread tension at the end of the heater after the second passage. These conditions are now practically achieved by using a thread deflecting element 10 as described below wherein the thread is transported without friction in the deflecting element and wherein the thread tension is reduced toward zero in the process.

Referring to FIGS. 2 and 3, the thread deflecting element 10 is shown enlarged and in detail. The deflecting element 10 includes a mounting plate 13, and a counter-piece 14 mounted on the plate 13 via screws 16 and a plate 15 which is clamped between the mounting plate 13 and counter-piece 14. A cover plate 18 is also fixed on the plate 13 via a screw 17. The cover plate 18 is provided with a circular hollow chamber or recess 19 which, via a horizontal branch duct 20 in the mounting plate 13, is connected with a vertical duct 21 extending through the mounting plate 13. This duct 21 is, in turn, connected with a tube section 30 of a compressed air duct (not shown) which is screwed into the plate 13.

The face side of the plate 15 extends arcuately, for example in a semi-circle and forms the base surface of an arcuate thread deflecting groove or thread passage groove 24 which is formed together with the mounting plate 13 and the counter-piece 14. The cover plate 18, which is larger than the plate 15, is provided with a semi-circular concentric counter-face side extending at a small distance from the thread deflecting groove 24, such that a thread insertion duct 25 is formed between the counter-piece 14 and the cover plate 18.

The plate 15 also has a circular hollow chamber or recess 22 which communicates via a horizontal branch duct 23 in the mounting plate 13 with the vertical duct 21. As shown in FIG. 3, the plate 15 also has a duct 26 with a very small cross-section which extends from the recess 22 and merges tangentially into the groove 24 at the thread entrance to the groove 24 from the side within the curvature of the groove 24. A similar duct 27 also of small cross-section extends from the hollow recess 19 in the cover plate 18 to a point downstream of the apex of the thread insertion duct 25 immediately above the thread deflecting groove 24 to direct a stream of air towards the thread exit from the groove 24, merging almost tangentially into the thread insertion duct 25 from outside the curvature of the groove 24.

The lower part of the mounting plate 13 is provided with two threaded bores 28 for mounting of the thread deflecting element 10 on a rail of the set heater 9 by means of screws 29. The thread deflecting element 10 can also be constructed as a double deflecting element for treatment of two threads on the same set rail. In this arrangement, the parts shown in FIG. 3, are duplicated and arranged symmetrically with respect to the vertical duct 21.

In operation, compressed air from the duct 30 is delivered to the duct 21 and passes via the branch ducts 20 and 23 to the hollow chambers or recesses 19 and 22. The air then flows via the small ducts 26, 27 into the thread deflecting groove 24. The air flowing from the duct 26 causes the thread extending in the direction of the arrows 32, 33 to be deflected and transported in the thread deflecting groove 24 on an air cushion practically without contact. The air flowing from the duct 27 prevents interruption of the air stream in the groove 24 and transports the thread further and prevents the thread from jumping out of the groove 24. The combination of the air flowing from the ducts 26, 27 effects a practically friction-free transport and deflection of the thread in such manner that the thread leaves the thread deflection element 10 practically without tension.

As the air from the duct 26 is to flow out as parallel as possible with respect to the thread path, the angle $\alpha$ of the plate wedge 31 limiting the duct 26 is kept as small as possible. The duct 27 merges preferentially shortly downstream of the apex of the thread insertion duct 25 approximately trangentially under an angle $\beta$ with respect to the horizontal into the duct 25 above the thread deflecting groove 24.

For purposes of example, it has been found that for a correct deflection of a polyester filament bundle of 167 dtex at a 16 percent relaxation, which is guided twice over a set heater of a length of 2 meters at a speed of 800 meters per minute, e.g. a thread deflecting element of the following dimensions has proven very suitable:

| | |
|---|---|
| diameter of the semi-circular face side of the plate 15 = | 12 millimeters (mm) |
| width of the thread deflecting groove 24 = | 1 millimeter (mm) |
| depth of the thread deflecting groove 24 = | 2 millimeters (mm) |
| distance between the plate 15 and the cover plate 18 = | 3 millimeters (mm) |
| cross-section of the ducts 26 and 27 = | 1 sq.millimeter (sq.mm) |
| angle $\alpha$ = | approx. 10 degrees |
| angle $\beta$ = | approx. 45 degrees |

Using these deflecting parameters at an air flow from the ducts 26 and 27 of 0.4 to 0.7 bar above atmospheric pressure in processing the above-mentioned polyester thread, a texturing length reduction EK of 27% and a nominal texturing length reduction of KK of 18% and a texturing consistency KB of 80% were reached.

What is claimed is:

1. A thread deflecting element for a heater of a draw-texturing machine, said element comprising means defining an arcuate groove for passage of a thread, said groove having a thread entrance at one end and a thread exit at an opposite end;

a first duct merging into said groove from a side within the curvature of said groove; and a second duct merging into said groove from an opposite side outside said curvature of said groove.

2. A thread deflecting element as set forth in claim 1 wherein said groove has a semi-circular curvature.

3. A thread deflecting element as set forth in claim 1 wherein said first duct merges into said groove at said entrance.

4. A thread deflecting element as set forth in claim 1 wherein said second duct merges into said groove downstream of the apex of said groove.

5. A thread deflecting element as set forth in claim 1 wherein said means includes a mounting plate; a counter-piece mounted on said mounting plate; a plate clamped between said mounting plate and said counter-piece, said plate having a semi-circular face side defining one side of said groove; and a cover plate mounted on said mounting plate and having a counter-face side concentric to and spaced from said semi-circular face side of said plate.

6. A thread deflecting element as set forth in claim 5 wherein said plate contains a first hollow recess in communication with said first duct and said cover plate contains a second hollow recess in communication with said second duct, and which further comprises a third duct extending through said mounting plate to deliver compressed air therethrough and a pair of branch ducts, each branch duct extending from said third duct to a respective one of said hollow recesses to deliver compressed air thereto.

7. A thread deflecting element as set forth in claim 6 wherein said first duct and said second duct merge approximately tangentially from a respective recess into said groove.

8. A thread deflecting element for a heater of a draw-texturing machine, said element comprising means defining an arcuate groove for passage of a thread, said groove having a thread entrance at one end and a thread exit at an opposite end;

a first duct means for delivering compressed air into said groove from a side within the curvature of said groove; and a second duct means for delivering compressed air into said groove from an opposite side.

9. A thread deflecting element as set forth in claim 8 wherein said first duct means includes a first duct extending approximately tangentially into said groove at said thread entrance to direct a flow of compressed air into said groove and said second duct means includes a second duct extending into said groove downstream of the apex of said groove to direct a flow of compressed air towards said thread exit.

10. A thread deflecting element comprising a mounting plate;

a counter-piece mounted on said mounting plate;

a plate clamped between said mounting plate and said counter-piece, said plate having an arcuate face side to define an arcuate groove with said mounting plate and said counter-piece, said groove having a thread entrance at one end and a thread exit at an opposite end;

a cover plate mounted on said mounting plate and having a counter-face side opposite to and spaced from said face side of said plate;

a duct extending through said mounting plate to deliver compressed air therethrough;

a pair of branch ducts in said mounting plate in communication with said duct to receive compressed air therefrom;

a first recess in said plate in communication with one of said branch ducts to receive compressed air therefrom;

a duct in said plate extending from said first recess to said groove to deliver compressed air into said groove from a side within the curvature of said groove;

a second recess in said cover plate in communication with the other of said branch ducts to receive compressed air therefrom; and a duct in said cover plate extending from said second recess to said groove to deliver compressed air into said groove downstream of the apex of said groove and towards said thread exit.

11. In combination a heater of a draw-texturing machine having a pair of parallel heating paths for a travelling thread; and a thread deflecting element mounted on said heater for directing a travelling thread from one of said paths into the other of said paths, said element comprising means defining an arcuate groove for passage of the thread, said groove having a thread entrance at one end to receive the thread from said one path and a thread exit at an opposite end to deliver the thread to said other path, a first duct means for delivering compressed air into said groove from a side within the curvature of said groove; and a second duct means for delivering compressed air into said groove from an opposite side.

12. A thread deflecting element for a heater of a draw-texturing machine, said element comprising means defining an arcuate groove for passage of a thread, said groove having a thread entrance at one end and a thread exit at an opposite end; and means for delivering compressed air into said groove at least from a side within the curvature of said groove, said means for delivering compressed air including a duct merging approximately tangentially into said groove at said thread entrance to direct a flow of compressed air into said groove.

13. An element as set forth in claim 3 wherein said first duct merges into said groove tangentially thereto.

14. An element as set forth in claim 4 wherein said second duct is disposed to direct a stream of air towards said thread exit.

15. In combination a heater of draw-texturing machine having a pair of heating paths for a travelling thread;

means for transporting the thread to one of said paths and away from the other of said paths; and a thread deflecting element mounted on said heater for directing a travelling thread from said one path into said other path, said element comprising means defining an arcuate groove for passage of the thread, said groove having a thread entrance at one end to receive the thread from said one path and a thread exit at an opposite end to deliver the thread to said other path, a first duct means for delivering compressed air into said groove from a side within the curvature of said groove, said duct means including a duct merging approximately tangentially into said groove at said thread entrance to direct a flow of compressed air into said groove to reduce thread tension at said thread exit to zero.

16. The combination as set forth in claim 15 which further comprises a second duct means for delivering compressed air into said groove from an opposite side.

17. In combination a heater of a draw-texturing machine having a pair of heating paths for a travelling thread;

means for transporting the thread to one of said paths and away from the other of said paths; and a thread deflecting element mounted on said heater for directing a travelling thread from said one path into said other path, said element comprising means defining an arcuate groove for passage of the thread, said groove having a thread entrance at one end to receive the thread from said one path and a thread exit at an opposite end to deliver the thread to said other path, a first duct means for delivering compressed air into said groove from a side within the curvature of said groove, and a second duct means for delivering compressed air into said groove from an opposite side, said duct means being disposed to effect symmetrical tension conditions in the thread over said paths.

18. The combination as set forth in claim 17 wherein said first first duct means includes a duct merging approximately tangentially into said groove at said thread entrance to direct a flow of compressed air into said groove.

* * * * *

UNITED STATES PATENT AND TRADEMARK OFFICE

CERTIFICATE OF CORRECTION

PATENT NO. : 4,194,350

DATED : March 25, 1980

INVENTOR(S) : Hans Schellenberg & Walter Vetterli

It is certified that error appears in the above—identified patent and that said Letters Patent is hereby corrected as shown below:

Column 4, line 4 change "trangentially" to --tangentially--.

Column 6, line 63 after "said" delete second occurrence of --first--.

Signed and Sealed this

*Twenty-ninth* Day of *July 1980*

[SEAL]

*Attest:*

SIDNEY A. DIAMOND

*Attesting Officer*

*Commissioner of Patents and Trademarks*